United States Patent [19]

Ban et al.

[11] Patent Number: 4,468,292

[45] Date of Patent: Aug. 28, 1984

[54] PRODUCTION OF HIGHLY RUST RESISTANT TINPLATE SHEETS FOR WELDED CANS

[75] Inventors: Tenji Ban; Kazuo Mochizuki, both of Chiba; Yasuhei Sakamoto, Togane; Shunichi Harada, Chiba, all of Japan

[73] Assignee: Kawasaki Steel Corporation, Hyogo, Japan

[21] Appl. No.: 384,665

[22] Filed: Jun. 3, 1982

[30] Foreign Application Priority Data

Jun. 10, 1981 [JP] Japan ..... 56-89385

[51] Int. Cl.[3] ..... C25D 5/12; C25D 5/50

[52] U.S. Cl. ..... 204/27; 204/35.1; 204/37.3; 204/40; 428/648

[58] Field of Search ..... 204/27, 28, 32 R, 35 R, 204/37 T, 38 R, 40, 41, 56 R; 428/648

[56] References Cited

U.S. PATENT DOCUMENTS

| | | | |
|---|---|---|---|
| 3,890,164 | 6/1975 | Harada et al. | 148/6.2 |
| 3,925,171 | 12/1975 | Jargon et al. | 204/56 R |
| 3,978,803 | 9/1976 | Asano et al. | 113/120 A |
| 4,035,248 | 7/1977 | Asano et al. | 204/38 B |
| 4,104,135 | 8/1978 | Fujimaki et al. | 204/37 T |
| 4,388,158 | 6/1983 | Inui et al. | 204/27 |

*Primary Examiner*—G. L. Kaplan
*Assistant Examiner*—William T. Leader
*Attorney, Agent, or Firm*—Young & Thompson

[57] ABSTRACT

A process for improving the rust and corrosion resistance of thinly coated tinplate is disclosed, wherein a steel sheet coated with 0.02–0.2 g/m$^2$ of nickel prior to annealing is coated with 0.05–1.5 g/m$^2$ of tin, subsequently being trated with 0.3–10 C/dm$^2$ of chromate and then subjected to a treatment of melting tin (reflow). A layer of alloy thus formed is highly rust resistant and structurally different from any of those formed on thinly coated tinplate according to the prior art, so that highly rust resistant tinplate sheets for use in the manufacture of welded cans can be obtained.

1 Claim, 6 Drawing Figures

PRODUCTION OF HIGHLY RUST RESISTANT TINPLATE SHEETS FOR WELDED CANS

BACKGROUND OF THE INVENTION

This invention relates to a process for improving the rust resistance of thinly coated tinplate covered with 1.5 g/m$^2$ or less of thin for the manufacture of cans for foods and drinks, the seams of such can bodies being joined by welding.

Solder has been used to join the seams of can bodies up to the present when cans for foods and drinks are manufactured. However, because poisonous lead contained in solder may dissolve in the contents of cans, solder made of pure tin has come to be used to join the seams of can bodies recently. In addition, seam welding (Soudronic welding) in place of soldering using expensive tin is being popularized to join the seams. Since the width of (overlapped) seams of can bodies in the Soudronic welding is 0.3–0.4 mm, the quality of welds is considerably affected by the method of treating the surface of a steel sheet. The smaller the plated amount of tin in tinplace on the market, the better its weldability tends to become. One of the reasons for this is that, for tinplate coated with the relatively large amount of tin, heat generated in resistance welding is also used to fuse tin, which flows along the weld line and causes the pickup of the weld zone. When thinly coated tinplate is used as material for making cans and particularly when cans with a coated inside surface are used, the material desired is, since the tin price is rising, the one which is coated with less than half of the amount of tin covering #25 tinplate, so to speak, which is said to be coated with the smallest amount of tin (2.8 g/m$^2$) on the market. In the case of this type of tinplate coated with the small amount of tin, however, it may generate rust during a period of several months after it has been manufactured and shipped until it is used for can manufacturing on the part of users, and in some circumstances may become unusable for can manufacturing.

SUMMARY OF THE INVENTION

The present inventors' strenuous efforts at the development of a process for improving the rust and corrosion resistance of thinly coated tinplate has resulted in the discovery of a layer of alloy highly rust resistant and structurally different from any of those formed on thinly coated tinplate according to the prior art, if a steel sheet which has been coated with 0.02–0.2 g/m$^2$ of nickel prior to annealing is coated with 0.05–1.5 g/m$^2$ of tin and treated with 0.3–10C/dm$^2$ of chromate and then subjected to a treatment of melting tin (reflow).

DESCRIPTION OF THE DRAWINGS

FIGS. 2–5 are photographs of the surface structure of tinplate taken by an electron microscope, and in which:

FIG. 2 is a 10,000 times enlarged photograph, taken by the electron microscope, of a layer of alloy formed on ordinary tinplate (with the plated amount of tin: 0.85 g/m$^2$ and the amount of tin contained in the alloy: 0.38 g/m$^2$).

FIG. 3 is a 10,000 times enlarged photograph, taken by the electron microscope, of the layer of alloy formed on the tinplate completed by coating a steel sheet, which has been coated with 0.05 g/m$^2$ of nickel prior to annealing, with 0.8 g/m$^2$ of tin and providing the sheet with a treatment of melting tin (reflow).

FIG. 4 is a 10,000 times enlarged photograph, taken by the electron microscope, of the layer of alloy formed on the tinplate (with the amount of tin: 0.81 g/m$^2$ and the amount of tin contained in the alloy: 0.36 g/m$^2$) treated with chromate (5C/dm$^2$) before reflow.

FIG. 5 is a 10,000 times enlarged photograph, taken by the electron microscope, of the layer of alloy formed on the tinplate finished by coating a black sheet, which has been coated with 0.05 g/m$^2$ of nickel prior to annealing, with 0.78 g/m$^2$ of tin and further treating the sheet with 5C/dm$^2$ of chromate and subjecting it to the treatment of melting tin.

DETAIL DESCRIPTION OF THE INVENTION

Figure 1:
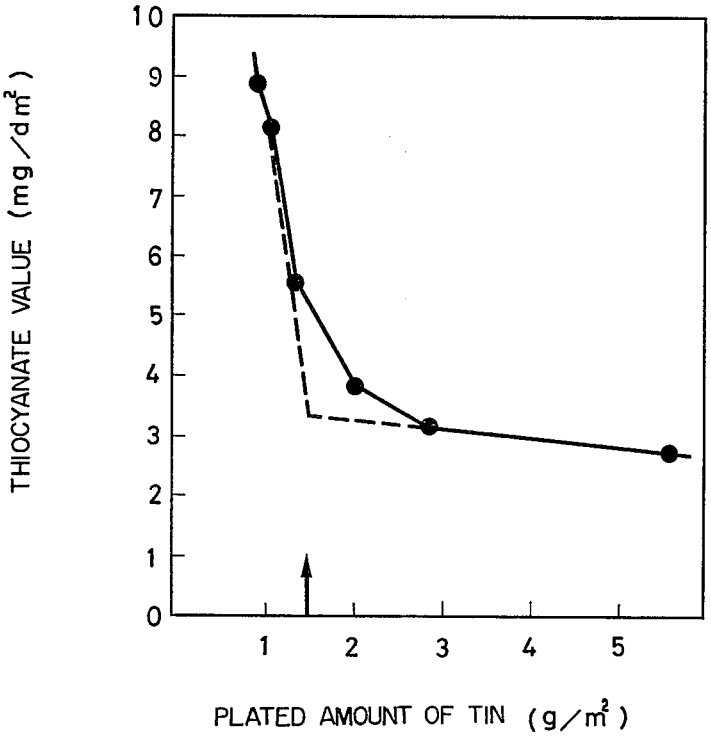
FIG. 1 is a graphic representation of the relation between the amount of tin that the tinplate is plated with and the thiocyanate value.
Figure 2:
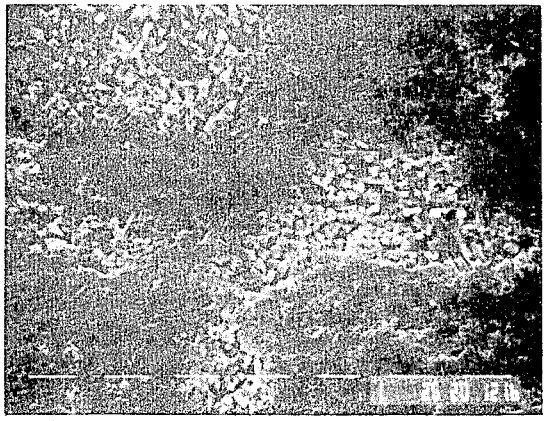

Tinplate made by coating a steel sheet with a smaller amount of tin is less rust resistant and the layer of tin covering the sheet is subjected to pinholes (exposure of bore steel through pores). The thiocyanate porosity test has long been known as an index employed to find the size and number of pinholes in tinplate. To make the thiocyanate test, a tinplate sheet having a certain area is soaked in a corrosive solution consisting of acetic acid, hydrogen peroxide and ammonium thiocyanic acid; whereas iron ions dissolved in the solution after the specified period of time are used as red thiocyanic acid iron for the measurement of color by means of a spectrophotometer. FIG. 1 shows the relation between the amount of tin that tinplate according to the prior art has been coated with and the thiocyanate value. In FIG. 1, the amount of tin alloy is 0.35–0.62 g/m$^2$, and the chromate processed amount is 4.5C/dm$^2$. As shown in the figure with a dotted line, tinplate coated with about 1.5 g/m$^2$ or less of tin is seen to have an extremely large area of exposed steel if the curve plotting the measured values is added to the figure. Although 4.5C/dm$^2$ of an electrolytic chromate treatment is normally given to a tin coated steel sheet after reflow for sealing pinholes, the still larger amoiunt of chromate is needed for a tin coated steel sheet coated with 1.5 g/m$^2$ of tin. However, because the chromate film formed after reflow is made from an electrically insulating material, welding current is not allowed to flow easily if the film is thick, thus making it necessary to slow down the welding speed. For instance, when a steel sheet coated with a chromate film processed by 10C/dm$^2$ of electricity is welded by a seam welding machine, the welding current per nugget will decrease by 10% or more in comparison with the case wherein no chromate film is formed. If a tinplate sheet coated with 1.5 g/m$^2$ or less of tin is provided with a treatment of melting tin, a rough iron-tin alloy will grow as shown in FIG. 2 indicating the 10,000 times enlarged photograph, taken by the electron microscope, of the layer of alloy on the ordinary thinly coated tinplate coated with 0.85 g/m$^2$ of tin, while 0.38 g/m$^2$ of tin is contained in the alloy; that is, the exposure of bare steel is large.

Figure 3:
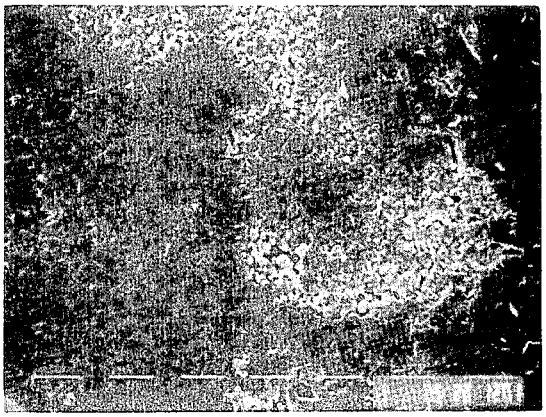

As the method of improving the corrosion resistance of tinplate by improving the fine structure and homogeneity the layer of iron-tin alloy, a process for manufacturing high corrosion resistant tinplate has been disclosed, for instance, in Japanese Patent Publication No. 20940, 1979 (Publication I), wherein a steel sheet coated with Ni is, before being coated with tin, heated in an unoxidizing atmosphere until nickel is allowed to diffuse into the steel sheet, and then it is permitted to substantially disappear as a coating. When the process disclosed in the Publication 1 is employed, the layer of alloy is certainly fine as shown in FIG. 3. However, the aforementioned process has not made it possible to increasingly improve the rust resistance of thinly coated tinplate coated with 1.5 g/m$^2$ or less of tin. FIG. 3 is a 10,000 times enlarged photograph, taken by the electron microscope, of the layer of alloy formed on the tinplate finished by coating a steel sheet, which has been coated with 0.5 g/m$^2$ of nickel prior to annealing, with 0.8 g/m$^2$ of tin and providing the sheet with a treatment of melting tin (reflow).

Figure 4:
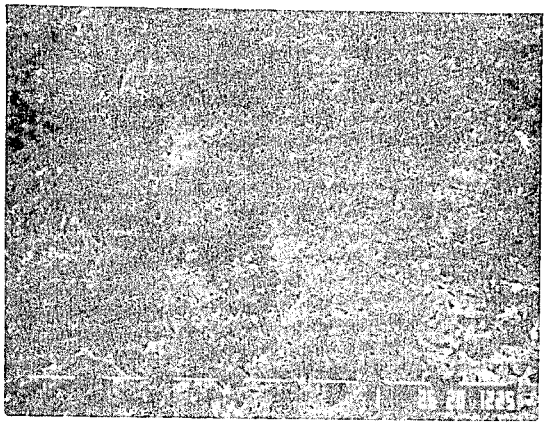

In addition, as the method of improving the sulfuration resistance of of tinplate, a process treating a steel sheet with chromate before reflow has been disclosed in Japanese Patent Publication No. 24619, 1973 (Publication II). When the process described in Publication II is applied to thinly coated tinplate, chromate applied before reflow is distributed in the layer of tin in the form of islands, which is the case different from that of thickly coated tinplate, for instance, #25 tinplate coated with 2.8 g/m$^2$ and more of tin on the market. This enables a thick layer of alloy to grow, so that the iron-tin alloy is prevented from becoming coarse (see FIG. 4). FIG. 4 is a 10,000 times enlarged photograph, taken by the electron microscope, of the layer of alloy formed on the thinly coated tinplate (with 0.82 g/m$^2$ of tin and 0.36 g/m$^2$ of tin in the alloy) treated with chromate (5C/dm$^2$) before reflow. However, even if the process described in Publication II is employed, still there is a small amount of bare steel left uncovered in the layer of tin.

Figure 5:
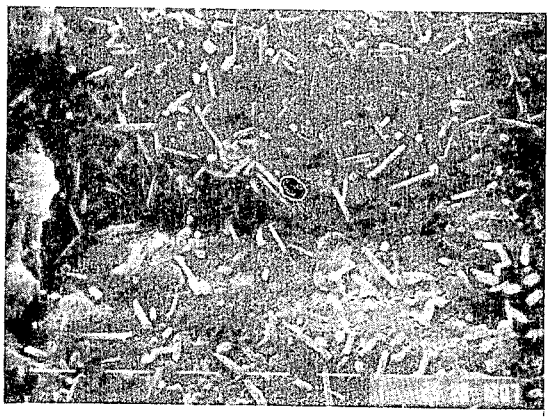

The present inventors have discovered that the layer of alloy on the tinplate shows an extremely uunique form if a steel sheet which has been plated with nickel prior to annealing is plated with tin and treated with chromate, before being provided with reflow (see FIG. 5). FIG. 5 is a 10,000 times enlarged photograph, taken by the electron microscope, of the layer of alloy formed on the tinplate (containing 0.41 g/m$^2$ of tin in the alloy) finished by coating a steel sheet, which has been coated with 0.05 g/m$^2$ of nickel prior to annealing, with 0.78 g/m$^2$ of tin and further treating the sheet with 5C/dm$^2$ of chromate and subjecting it to a treatment of melting tin. The photograph taken by the electron microscope in FIG. 5 proves that the layer of iron-tin alloy covering the bore steel is not in the form of needles nor sticks which is often the case with the prior art, but is composed of a layer formed with an aggregate of minute grains and a needle-, stick-shaped or granular iron-tin alloy on the former. This upper layer of iron-tin alloy is entirely unobservable in tinplate made according to the prior art and those using black sheets plated with nickel and annealed, and those treated with chromate before reflow.

Figure 6:
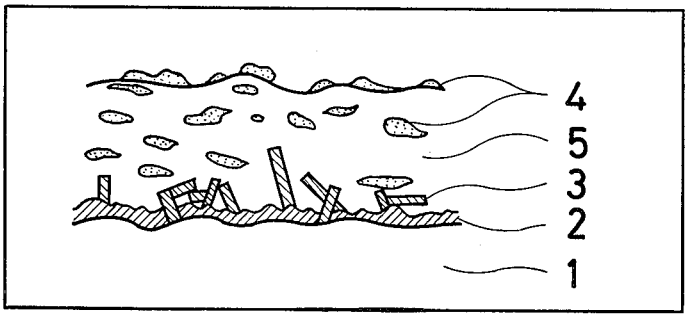
FIG. 6 is a diagrammatic sectional view of a portion near the surface of the thinly coated tinplate according to this invention.

The reason for the high rust resistance of the tinplate based on this invention is that, as shown in the conceptual sectional view of a portion near the surface of thinly coated tinplate according to this invention in FIG. 6, there are a layer of iron-tin alloy 2 composed of extremely minute grains as a lower layer on a steel sheet 1 and another layer of iron-tin alloy 3 effective in filling up pinholes on the lower layer. In addition, because the chromate 4 applied before reflow is distributed in the form of islands in the layer of tin 5 of the tinplate made according to this invention as shown in the figure, it becomes no obstacle to welding current.

Even for thinly coated tinplate, it is essential to make the layer of iron-tin alloy fine in order to improve its rust and corrosion resistance. The tinplate as material for welded can manufacturing aimed at in this invention must be so processed that it will not disturb the flow of welding current. The present inventors have examined various method of satisfying these two conditions. Such examination has resulted in this invention in which the layer of alloy on the tinplate finished by plating a black sheet with nickel prior to annealing, plating the sheet with tin and treating it with chromate and reflow is seen to have entirely different structure from those of conventional tinplate, and to be substantially free from pinholes.

A steel sheet to be used for manufacturing tinplate for welded can manufacturing based on the process according to this invention may be either one made by the ingot casting or continuous casting method. The steel sheet cold rolled to the thickness of 0.15–0.33 mm by the normal method is degreased and plated with nickel. The steel sheet is coated with 0.02–0.2 g/m$^2$ of nickel in an electrolytic plating bath such as the Watts plating bath, sulfamate acid plating bath, etc. now in use. The electrolytic temperature may be within the normal range at which the above electrolytic plating bath is used. The current density is preferably 1–30 A/dm$^2$. When the steel sheet is coated with 0.02 g/m$^2$ and less of nickel, pinholes are considerably produced in the layer of alloy of tinplate, with more than 0.02 g/m$^2$ generation of pinholes remarkably decrease, while when it is coated with more than 0.2 g/m$^2$, pinholes disappear substantially completely. More than 0.2 g/m$^2$ results in saturation of effects and economical demerits. For this reason, the amount of nickel has been determined 0.02–0.2 g/m$^2$. The cold rolled steel sheet coated with nickel is then washed with water, dried and box annealed or continuously annealed at temperatures of more than 550° C. and less than 720° C. For the manufacture of commercial tinplate, the dew point of annealing atmosphere (HNX gas: 5–7% $H_2+N_2$ mixed gas) is normally set to +3° C. or less. The dew point of annealing atmosphere used to anneal the steel sheet coated with nickel according to this invention may be within the above range. Part of the nickel applied to the steel sheet before annealing is diffused in the sheet, but the total amount of nickel attached through electrodepositing need not be introduced in the steel.

The annealed cold rolled steel sheet is skin pass rolled and coated with tin after it has been degreased and pickling. Coating the steel sheet with tin is carried out in the acid plating bath such as the halogen, ferrostan or boron fluoride plating bath or alkaline, so that more than 0.05 g/m$^2$ and less than 1.5 g/m$^2$ of tin is allowed to deposit on the sheet. The reason for limiting the amount of tin in this invention is that chromate is buried in the form of islands in the layer of tin at the process of reflow to make the iron-tin alloy minute. In other words, (1) for the steel sheet coated with 1.5 g/m$^2$ or more of tin, only a chromate layer is formed on the layer of tin and the layer of alloy cannot be made fine. (2) For the steel sheet coated with 0.05 g/m$^2$ or less of tin, even if a black sheet coated with nickel before annealing is used and treated with chromate before reflow, the generation of pinholes cannot be prevented.

The steel sheet plated with tin in the aforementioned way is successively treated with chromate. When the processing amount of chromate is less than 0.3C/dm$^2$ in this invention, the layer of alloy on the tinplate plated with 1.5 g/m$^2$ or less has not such structure as is shown in FIG. 5. When the processing amount of chromate is 10C/dm$^2$ and more, resistance against the seam welding current is greater because chromate in the layer of tin is not made in the form of islands. For the processing of chromate as the after-treatment of tinplate, 30 g/l of sodium dichromate solution (40°-60° C.) is normally used. This can also be applied to the chromate treatment before reflow in this invention. As for the electrolytic period of time and current density for chromate treatment, there is no particular limit as far as the volume of electricity as the sum of both is within the above range.

The steel sheet is plated with nickel before annealing and then plated with 0.05-1.5 g/m$^2$ of tin and treated with 0.3-10C/dm$^2$ of chromate and further provided with a treatment of melting tin (reflow). The layer of alloy formed at the time of reflow shows high density at the interface between iron and tin. Hence, even if the sheet is treated in the same way as ordinary tinplate is done, the amount of tin alloy becomes large. However, in view of weldability and rust resistance, the amount of tin alloy should be preferably about $\frac{2}{3}$ of the total amount of tin that the sheet is plated with. The steel sheet that has been provided with the treatment of reflow according to this invention is washed with water if necessary, dried, and chemically treated in the ordinary manner for filling up purposes; that is, supplied with cathodic treatment with 4.5C/dm$^2$ of electricity in 30 g/l of dichromic acid aqueous solution (at temperatures of 40°-60° C.). Details of this invention in reference to examples and comparisons are described as follows:

(EXAMPLE 1)

A steel sheet 0.22 mm thick that had been degreased after being cold rolled was plated with nickel in the Watts plating bath (60° C.) for 0.5 seconds with 2 A/dm$^2$ of current density. The nickel coated steel sheet was washed with water, dried, annealed at 650° C. for about 40 seconds and skin pass rolled by 0.6%. The steel sheet was electrolytically degreased in a solution mainly composed of sodium hydroxide, treated with pickling in a sulphuric acid solution and plated with 0.82 g/m$^2$ of tin in the halogen plating bath. After the sheet was washed by water, the sheet was provided with cathodic treatment in a 30 g/l sodium dichromate solution with 5 C/dm$^2$ of electricity. Then the sheet was washed with water, dried, heated up to 250° C. for 3.2 seconds, immediately cooled with water and provided with cathodic treatment in a 30 g/l sodium dichromate solution with 4.5C/dm$^2$ of electricity.

(EXAMPLE 2)

A steel sheet 0.22 mm thick that had been degreased after being cold rolled was plated with nickel in the Watts plating bath (60° C.) for 1.2 seconds with 2A/dm$^2$ of current density. The nickel coated steel sheet was washed with water, dried, annealed at 650° C. for about 30 seconds and skin pass rolled by 0.6%. The steel sheet was electrolytically degreased in a solution mainly composed of sodium hydroxide, treated with pickling in a sulphuric acid solution and plated with 0.52 g/m$^2$ of tin in the halogen plating bath. After the sheet was washed with water, the sheet was provided with cathodic treatment in a 30 g/l sodium dichromate solution with 7C/dm$^2$ of electricity. Then the sheet was washed with water, dried, heated up to 260° C. for 2.8 seconds, immediately cooled with water and provided with cathodic treatment in a 30 g/l sodium dichromate solution with 4.5C/dm$^2$ of electricity.

(EXAMPLE 3)

A sheet 0.22 mm thick that has been degreased after being cold rolled was plated with nickel in the Watts plating bath (60° C.) for 1.0 second with 3 A/dm$^2$ of current density. The nickel coated steel sheet was washed with water, dried, annealed at 650° C. for about 4 seconds and skin pass rolled by 0.6%. The steel sheet was electrolytically degreased in a solution mainly composed of sodium hydroxide, treated with pickling in a sulphuric acid solution and plated with 0.70 /m$^2$ of tin in the halogen plating bath. After the sheet was washed with water, the sheet was provided with cathodic treatment in a 30 g/l sodium dichromate solution with 5C/dm$^2$ of electricity. Then the sheet was washed with water, dried, heated up to 250° C. for 3.3 seconds, immediately cooled with water and provided with cathodic treatment in a 30 g/l sodium dichromate solution with 4.5C/dm$^2$ of electricity.

(Comparison 1)

A steel sheet 0.22 mm thick that had been degreased after being cold rolled was plated with nickel in the Watts plating bath (60°) for 0.5 seconds with 2 A/dm$^2$ of current density. The nickel coated steel sheet was washed with water, dried, annealed at 650° C. for about 40 seconds, and skin pass rolled by 0.6%. The steel sheet was electrolytically degreased in a water solution mainly composed of sodium hydroxide, treated with pickling in a sulphuric acid solution and plated with 0.85 g/m$^2$ of tin in the halogen plating bath. After the sheet was washed with water and dried, the sheet was heated up to 250° C. for 3.2 seconds. The sheet was immediately cooled with water and then provided with cathodic treatment in a 30 g/l sodium dichlomate solution (45° C.) with 4.5C/dm$^2$ of electricity.

(Comparison 2)

A steel sheet 0.22 mm thick that had been degreased after being cold rolled was plated with nickel in the Watts plating bath (60° C.) for 0.2 seconds with 1 A/dm$^2$ of current density. The nickel coated steel sheet was washed with water, dried, annealed at 650° C. for about 40 seconds, and skin pass rolled by 0.6%. The steel sheet was electrolytically degreased in a solution mainly composed of sodium hydroxide, treated with pickling in a sulphuric acid solution and plated with 0.85 g/m$^2$ of tin in the halogen plating bath. After the sheet was washed with water, the sheet was provided with cathodic treatment in a 30 g/l of sodium dichromate solution with 5C/dm$^2$ of electricity. Then the sheet was washed with water, dried, heated up to 250° C. for 3.2 seconds, immediately cooled with water and provided with cathodic treatment in a sodium dichromate solution with 4.5C/dm$^2$ of electricity.

(Comparison 3)

A steel sheet 0.22 mm thick that had been degreased and treated with pickling was plated with 0.93 g/m$^2$ of tin in the halogen bath, washed with water and treated with chromate in 30 g/l of a sodium solution (45° C.) with 12C/dm$^2$ of electricity. The tin coated steel sheet was washed with water, dried, heated up to 260° C. for 3.4 seconds, immediately cooled with water and then provided with cathodic treatment in a 30 g/l sodium dichromate solution (45° C.) with 4.5C/dm$^2$ of electricity.

(Comparison 4)

The steel sheet degreased and treated with pickling was plated with 0.85 g/m$^2$ of tin, washed with water, dried, heated up to 260° C. for 3.4 seconds, immediately cooled with water and provided with cathodic treatment in a 30 g/l sodium dichromate solution (45° C.) with 4.5C/dm$^2$ of electricity.

(Comparison 5)

The steel sheet degreased and treated with pickling was plated with 2.94 g/m$^2$ of tin, washed with water, dried, heated up to 260° C. for 3.4 seconds, immediately cooled with water and provided with cathodic treatment in a 30 g/l sodium dichromate solution (45° C.) with 4.5C/dm$^2$ of electricity. This tinplate is equivalent to #25 tinplate on the market.

A test piece 50×80 mm was obtained from the steel sheets treated in the manner above. Ends of the steel sheets were sealed with adhesive tapes leaving an area 40×70 mm. The test piece was subjected to the humidity test and the salt water spraying test as follows. In addition, the thiocyanate porosity test was also conducted. The seam weldability test was made according to the following conditions, using a test piece 165.5×80 mm.

(1) Humidity test

The test piece was attached to a test tank at 50° C. in temperature and 93% in humidity. After the elapse of a predetermined period of time, the areal percentage of red rust generated on the surface of the test piece was visually inspected.

(2) Salt water spraying test

The test was made based on JIS Z 2371. The areal percentage of red rust generated was visually inspected.

(3) Thiocyanate porosity test

The test was made in conformity with P30 issued by the Tin Research Institute (2nd edition, 1964).

(4) Seam weldability test (a) Welding machine: Can manufacturing machine produced by Soudronic AG.
Guide too for 202ϕ incorporated.
Overlap: 0.4–0.5 mm.
(b) Welding speed: 8 m/min.
(c) Welding current: 25–30 A per nugget.
(d) Pressure for joining seams of can body: 40 da.N.
(e) Test items:
(e-1) Hein Test Make V-shaped cut from the end of the cylinder sandwiching the weld, and hold the triangle with a plier and then pull it to the other direction. If the welded portion is not cut away in this way, it is regarded as 'good'.

(e-2) Observation of spatter

Visually check the weld per nugget for the presence of spatter.

(e-3) Observation of weld section by optical microscope

Weld section is encased in resin and observed under 100X. If there is no hairline, it is considered 'good'.

As shown in the following table that indicates the test results of the above test pieces, even if it is a thinly tin coated (0.05–1.5 g/m$^2$) steel sheet, excellent rust resistance and seam weldability almost equivalent to those of #25 tinplate on the market (amount of tin: 2.8 g/m$^2$) can be made possible by coating the nickel coated black sheet before annealing with tin, treating the sheet with 0.3–10C/dm$^2$ of chromate and providing it with reflow treatment.

TABLE 1

Rust Resistance and Weldability of Thinly Coated Tinplate

| Surface treatment | Amount of plating: Amount of nickel (prior to annealing) g/m$^2$ | Amount of plating: Total amount of tin g/m$^2$ | Amount of plating: Amount of tin of alloy g/m$^2$ | Amount of plating: Amount of Chromium (reflow pretreatment) mg/m$^2$ | Humidity test value (%): 7 days later | Humidity test value (%): 30 days later | Drying and wetting cycle test value (%): 7 days later | Drying and wetting cycle test value (%): 30 days later | Thiocyanate value mg/dm$^2$ | Seam weldability: Hein test | Seam weldability: Weld section observation | Seam weldability: Generation of spatter |
|---|---|---|---|---|---|---|---|---|---|---|---|---|
| Example (1) | 0.043 | 0.82 | 0.36 | 7.1 | 10 | 15 | 5 | 5 | 2.37 | Good | Good | None |
| Example (2) | 0.102 | 0.52 | 0.21 | 8.1 | 7 | 9 | 2 | 3 | 1.10 | Good | Good | None |
| Example (3) | 0.091 | 0.70 | 0.25 | 9.7 | 8 | 11 | 3 | 4 | 1.20 | Good | Good | None |
| Comparison (1) | 0.047 | 0.85 | 0.44 | — | 15 | 25 | 15 | 20 | 4.62 | Good | Good | None |
| Comparison (2) | 0.005 | 0.88 | 0.39 | 6.5 | 15 | 35 | 20 | 25 | 3.01 | Good | Good | Good |
| Comparison (3) | — | 0.93 | 0.41 | 14.4 | 12 | 17 | 10 | 15 | 2.96 | Good | Hairline is partially visible | Many |
| Comparison (4) | — | 0.85 | 0.38 | — | 52 | 90 | 40 | 75 | 8.95 | Good | Good | None |
| Comparison (5) | — | 2.94 | 0.64 | — | 10 | 25 | 15 | 15 | 3.30 | Not good | good | None |

What we claim is:

1. A process for manufacturing rust-resistant thinly coated tinplate suitable for making welded cans, comprising the steps of electroplating a cold-rolled, degreased steel sheet with nickel to a build-up of 0.02 to 0.2 g/m$^2$, annealing the nickel-plated sheet at a temperature of 550° to 720° C. to cause at least part of the nickel to diffuse into the underlying steel, skin-pass rolling the sheet, further electroplating the sheet with tin to a build-up of 0.05 to 1.5 g/m$^2$, subjecting the tin-plated sheet to electrolytic chromate treatment with an electricity quantity of 0.3 to 10C/dm$^2$, and thereafter heating the sheet to cause the tin to reflow to form a high density iron-tin alloy layer at the steel-tin interface.

* * * * *